US005533853A

United States Patent [19]

Wu

[11] Patent Number: 5,533,853

[45] Date of Patent: Jul. 9, 1996

[54] APPARATUS AND METHOD FOR EJECTING WORKPIECES FROM FORMING MACHINES

[75] Inventor: Samuel C. Wu, Lakewood, Colo.

[73] Assignee: Glenn Bott, Arvada, Colo.

[21] Appl. No.: 246,329

[22] Filed: May 19, 1994

[51] Int. Cl.[6] ..... B21D 51/00

[52] U.S. Cl. ..... 413/31; 269/290; 269/909

[58] Field of Search ..... 413/4–7, 31, 35, 413/36, 37, 52, 53; 53/334, 368, 486; 269/13, 14, 47, 48, 290, 909

[56] References Cited

U.S. PATENT DOCUMENTS

| | | | |
|---|---|---|---|
| 1,373,001 | 3/1921 | Gray | 413/37 |
| 2,385,429 | 9/1945 | Underwood | 413/4 |
| 3,025,814 | 3/1962 | Currie | 413/31 |

*Primary Examiner*—Jack W. Lavinder

*Attorney, Agent, or Firm*—Timothy J. Martin; Michael R. Henson

[57] ABSTRACT

An apparatus and method is disclosed for ejecting workpieces from machines, especially lidded containers from lid seamers, that have a forming station including a chuck element and a forming roller and that have a positioning mechanism that advances to move the workpiece into engagement with the forming station. The apparatus and method utilize a resilient element to exert an ejecting force. The resilient element is disposed on the chuck element in a manner so that engagement of the workpiece operates to compress, either by compression or deflection, the resilient element so that it exerts a restorative force that ejects the workpiece. Where a lid seamer is sued with a pull opener (e.g., pop top) lid, the contact with the resilient member occurs a location spaced from the opener and its connecting elements. The resilient element is preferably cup-shaped having a central panel and a longitudinally and radially outwardly projecting lip. A variety of constructions of the resilient element and manners of mounting to the chuck element and its associated spindle are described.

36 Claims, 3 Drawing Sheets

APPARATUS AND METHOD FOR EJECTING WORKPIECES FROM FORMING MACHINES

FIELD OF THE INVENTION

The present invention broadly concerns metal forming machines and, particularly, ejector apparatus and methods for ejecting a workpiece from the metal forming machine. More specifically, however, the present invention is directed to ejector apparatus for use with lid seamers for ejecting a lidded container after the lid has been seamed onto a previously open container rim. The present invention especially is directed to lid seamers for use with lidded containers wherein the lid has a pull opener with the ejector assembly operative to eject the lidded container without damage to the pull tab seal.

BACKGROUND OF THE INVENTION

The use of automated machinery to perform machining functions on workpiece has become an essential part of modern manufacturing technology. In such automated equipment, it is typical that one or more forming stations are provided. A workpiece is advanced into engagement with the forming station by means of a positioning mechanism. Upon retraction of the positioning mechanism, the workpiece is ejected from the forming station so that the metal forming cycle can be repeated. Ejection of the formed workpiece is accomplished by gravity or, in some instances, by an ejector rod that may, for example, be mechanically actuated to apply a jarring force to the workpiece to eject the workpiece from the forming station.

A specific example of such a machine adapted to perform a machining function, and a type of machine to which the present invention is particularly directed, is a lid seamer which is used in the food and beverage industry. Here, an open container having an open mount and an upper rim is filled with a product, and a lid is registered with the upper rim so that the combination lid and rim are seated on a chuck assembly as a workpiece. The open container has a can flange, and the lid has an end flange which are placed in registration adjacent to an outer forming surface of a chuck element. One or more forming rollers then revolve around the chuck element to roll the flanges together thus seaming the lid onto the container to produce a sealed, lidded container that is then ejected for packaging. As described more fully below, and as shown in the prior art FIG. 1, such lid seamers are commonly used in the beverage industry. Here, however, the standard ejector mechanism is in the form of a knock-out rod that is cam actuated so as to be mechanically timed to tap the center of the lidded beverage can thereby to eject it from the chuck assembly in the forming station. One such machine of this type in common usage is the Angelus sanitary seaming machine made by Angelus of Los Angeles, Calif.

Use of a knock-out rod of a type typically employed in the industry is not without its problems, however. Even though only a slight force of approximately twenty pounds is necessary to eject a lidded beverage can, the impact of the knock-out rod on the center of the joined lid may rupture the pull opener seal (score) or rivet. This may create several problems. On one hand, rupturing the seal can allow contamination of the food product by bacteria or other microbial organisms, which can endanger the consumer of the food product. On another hand, where a carbonated beverage is packaged in the lidded container, rupture of the pull tab seal or rivet allows the escape of the carbonating gas so that the contained beverage may go "flat" and thus be an undesirable consumer product. It can further lead to the loss of product since the occurrence of any of these events is undesirable to the manufacturer, most manufacturers are quite concerned about quality control of the pull tab integrity.

Even where the pull tab is not ruptured, several other disadvantages arise from use of a knock-out rod. One such disadvantage is the fact that the knock-out rod along with its associated mechanical structure including cam followers, cam grooves and the like greatly increase the complexity of most lid seamers. thus, such machines are expensive and are costly to maintain. Moreover, since the knock-out rod reciprocates a spindle assembly which mounts the forming chuck, it is necessary to lubricate the knock-out rod and its associated bushings, bearings, etc. The presence of lubrication always prevents the problem of leakage which, in rare instances, might contaminate the food product as the open container moved into position under the chuck assembly or, more often, can result in contamination of the surface of the lid after it is seamed onto the container by the leaked lubricating medium. Again, where a beverage can is concerned, a problem arises since consumers often drink the beverage directly from the beverage can so that a user might place his/her mouth on the lid contaminated with the lubricating medium. Further, the inertial mass of the reciprocating knock-out rod and its associated mechanical linkages acts limit on the speed at which such machines can operate.

Accordingly, there has been a long felt need for an improved ejector apparatus and method for machines in general and especially for lid seamers. There has been a need for ejector apparatus and methods which reduce the complexity of such machines by eliminating tradition complex mechanical knock-out rod assemblies. Further, a need has existed for ejector apparatus and methods for lid seamers which reduce the possibility of contamination of the food product where such lid seamers are used in the food and beverage industry.

SUMMARY OF THE INVENTION

It is an object of the present invention to provide new and useful improvements to machines which require ejector mechanisms that assist in ejecting a workpiece from a forming station.

Another object of the present invention is to provide an ejector apparatus which reduces the complexity of forming machinery.

Still a further object of the present invention is to provide a lid seamer for lids with pull openers which incorporates ejector apparatus and method that reduce the incidence of pull tab seam rupture during the ejecting process after a lid has been seamed on an open container.

Another object of the present invention is to provide an ejector apparatus and method for lid seamers that reduces the incidence of contamination by lubricating media.

Still another object of the present invention is to provide a new and useful chuck assembly incorporating an ejector apparatus that may retrofit onto existing machines, especially lid seamers, that reduces the cost of maintaining such machinery.

A further object of the present invention is to provide an improved ejection method and improved ejector apparatus which may allow automated machining functions to proceed at greater speeds.

Yet another object of the present invention is to eliminate traditional knockout rods from lid seamers.

To accomplish these objects, then, the present invention is directed to a chuck assembly for use on metal forming machines wherein the chuck assembly incorporates simplified ejector structure that acts to eject the workpiece from a workstation of the machine. The present invention also concerns a method for ejecting workpieces from such workstations. The present invention also is directed to improvements in existing metal forming machines, such as lid seamers. In each case, the present invention seeks to meet the objects as stated above.

In broad form of the present invention, an improvement is provided to a machine that is adapted to perform a machining function on a workpiece. Here, the machine has a forming station that includes at least one forming roller and wherein the machine has a positioning mechanism that operates to advance so as to move the workpiece into an engaged position in the forming station so that the machining function can be performed thereon and which can retract so that the workpiece can be ejected from the forming station. The invention is directed to an improvement including a chuck element that is mounted to the machine and which has a forming surface cooperative with a forming roller to perform the machining function. A resilient element is mounted on the chuck element and is positioned so that, when the workpiece is in the engaged position, a portion of the workpiece engages the resilient element thus collapsing the resilient element. When the positioning mechanism retracts, the resilient element operates to exert a restorative force on the workpiece thereby to reject the workpiece from the forming station. Where the machine is a lid seamer, preferably the chuck element has a central axis extending longitudinally therethrough and a recess is formed at one end thereof so that an upstanding peripheral rim extends circumferentially around one end of the chuck element, and the resilient member is here disposed in the recess.

In one embodiment of the invention, a groove is formed in the recess, and the resilient element includes a central panel having a ridge structure projecting away from a first side thereof and operative to be matably received in the groove thereby to secure the resilient element in a fastened state to the chuck element. An adhesive material may be placed in the groove in order to adhere the lid structure of the resilient element in the groove. Also, one or more walls of the groove and the ridge structure may both be formed at a large acute angle relative to a transverse plane that is oriented perpendicularly to the central axis of the chuck assembly so that the ridge structure and the groove may be snap-fitted together.

It is preferred that the resilient member includes a lip structure that projects outwardly from a side of the central panel opposite the first side, whether or not the ridge structure is provided. This lip structure is located proximately to a perimeter of the central panel and is sized so that, when the workpiece is seated on the rim, the lip structure is collapsed thereby to exert the restoring force. In one embodiment, the lip structure terminates in an enlarged lobe. In another embodiment, the lip structure terminates in an arcuate portion that is inwardly turned from the perimeter of the central panel. In another embodiment, the lip structure has a lip wall that is tapered in cross-section and, in still another embodiment, the lip structure and/or the resilient element may be formed of a close cell polymer foam material. Preferably, however, the resilient element and lip structure is formed of an integral piece of rubber material that is mounted to the chuck element and the recess thereof.

While it is preferred that the resilient element be mounted by means of the ridge structure and groove describe above, alternative mounting structure is contemplated by this invention. In one alternative, a fastening element is operative to engage the chuck assembly and the resilient element thereby to mechanically mount the resilient element thereto. In one machine structure, the chuck element may be mounted on a spindle which has a longitudinal passageway extending therethrough. The chuck element is threaded onto the spindle and includes a central axially opening which aligns with the spindle passageway. The resilient element may include an enlarged nose which extends from a central panel portion into the longitudinal passageway, and a plug member may be inserted to wedgedly mount the resilient member to the spindle and thus to the chuck element mounted thereon. Alternatively, the central panel of the resilient element may include a central opening, and a plug member may be inserted therethrough to engage the interior of the longitudinal passageway of the spindle. In either event, the plug preferably has a radially outwardly extending shoulder which bears against the resilient element thereby to seal the central opening of the chuck element and the longitudinal passageway of the spindle. Still another alternative includes longitudinal threaded bores in either the spindle or chuck element, and the resilient element is attached by machine screws.

Where the present invention is used with a lid seamer for producing a lidded container wherein the lid thereof has a centrally located pull tab, it is preferred that the lip structure extends annularly around a central panel of the resilient member proximately to the perimeter thereof. The annular lip structure is sized so that, when the lid is seated on the rim of the chuck, the lip structure extends in spaced-relation around the pull tab and contacts a peripheral margin portion of the lid away from the pull tab.

The present invention also concerns a method of ejecting a workpiece from a machine that is adapted to perform a machining function. Here, the machine includes a chuck element having a seat adapted to receive the workpiece in an engaged position, at least one forming roller operative to cooperate with the chuck element thereby defining a forming station for performing the machining function, and a positioning mechanism operative to advance so as to move the workpiece into an engaged position in the forming station and to retract whereby the workpiece can be ejected from the forming station. The method according to the present invention broadly includes the steps of first securing a resilient element in a fixed relation relative to the chuck element in a manner such that the resilient element will be contacted by and collapsed by the workpiece when the workpiece is moved into the engaged position. Next, the method includes the step of advancing the positioning mechanism so that the workpiece is moved into the engaged position simultaneously contacting and collapsing the resilient element. Thus, the resilient element exerts a restorative force tending to eject the workpiece from the chuck element. Next, the method includes the step of holding the workpiece in the engaged position against the restorative force until the machining function is completed. Finally, the broad method includes the step of retracting the positioning mechanism after the machining function is completed whereby the resilient element is allowed to rebound to eject the workpiece. Here, the resilient element is constructed such that the restorative force applied by the resilient element is sufficient to reject the workpiece from the forming station after the machining function is performed thereon.

The method according to the present invention can specifically be used with a machine that is a lid seamer wherein the machining function is the seaming of a lid onto an upper rim of the container wherein the lid has a pull opener. Here, the step of contacting the resilient element is performed by the lid and occurs only at portions of the lid located in spaced relation from the pull opener. Further, the method according to the present invention can include any of the steps inherently practiced by the apparatus described above.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed generally to metal forming machines that include forming stations operative to receive workpieces for performing a machining function thereon. Of particular concern of the present invention are improvements to the method and apparatus for ejecting a workpiece from such a forming station. Thus, the present invention is directed to new and useful embodiments of resilient ejectors that may retrofit onto existing chuck assemblies for such machines and, furthermore, to the combination of improved chuck elements with such resilient ejectors. Thus, the invention provides both retrofit capability for existing machines as well as to improvements to original (O.E.M.) equipment. Moreover, the present invention is particularly directed to ejector apparatus and methods for use with lid seaming machines of the type operative to seam or join lids onto containers such as used in the food and beverage industry. Thus, for purposes of example only and not for limitation as to the overall scope, this invention will be described hereinafter in conjunction with a lid seaming apparatus for a container such as a beverage can. It is to be clearly understood from the outset, though, that the exemplary embodiments of the present invention and the methods employed could be utilized on other types of machine forming equipment, especially those incorporating ejector rods.

Figure 1:
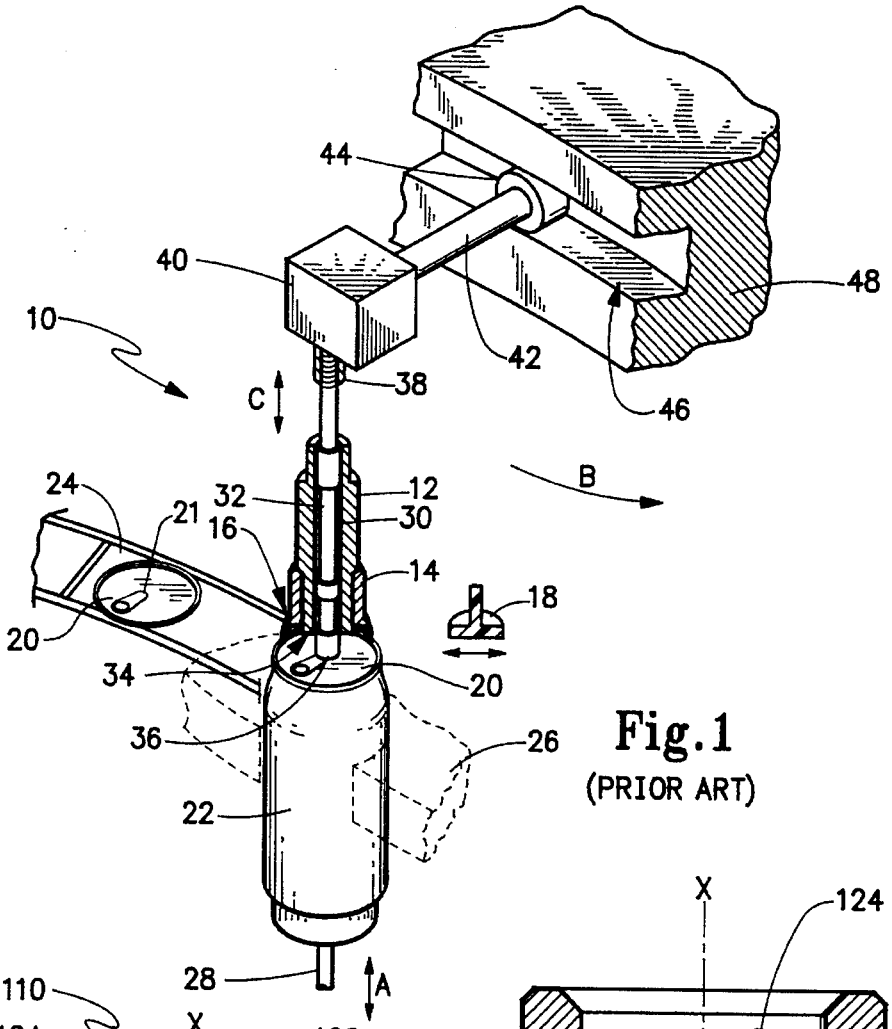
Fig.1 (PRIOR ART)
FIG. 1 is a perspective view in partial cross-section showing a lid seamer according to the prior art for seaming a pull tab lid onto a beverage container.

In order to better understand the present invention, it is first helpful to review a standard-type of forming station used in the beverage can industry. Thus, with reference to FIG. 1, it may be seen that a standard lid seamer 10 includes an elongated spindle 12 that is fixedly mounted to the machine such as by a housing or turret (not shown). A chuck element 14 is threadably mounted on a distal end of spindle 12 and includes a working surface 16 that interacts with a forming roller 18 to seam a lid 20 onto a container, such as beverage can 22. Chuck element 14 and forming roller 18 thus define a forming station, and lids 20 are delivered to this forming station by means of gravity feed 24. Unlidded beverage cans 22 are moved into position with the forming station, for example, by star wheel 26 (shown in phantom). A push pad 28 reciprocates in the direction of arrow "A" and thus provides a positioning mechanism operative to first advance so as to move can 22 into a engaged position with the forming station and then to retract whereby the lidded can or container can be ejected from the forming station.

To assist in ejecting the lidded can from the forming station, it is common practice to form a longitudinal passageway 30 through spindle 12 to reciprocally mount a knock-out rod 32 therein by means of suitable bearings and bushings. Accordingly, chuck element 14 has a central opening 34 that registers in axially alignment with longitudinal passageway 30 so that head 36 of knock-out rod 32 may protrude through opening 34 so as to selectively contact lid 20 thereby to assist in ejecting the lidded beverage can from the workstation.

To supply the knock-out or ejection force, an end 38 of knock-out rod 32 opposite head 36 is connected to a mounting block 40 which in turn is secured to a cam follower 42. Cam follower 42 includes a roller 44 received in a camming groove 46 formed in turret portion 48 so that, as the forming station revolves around stationary turret portion 48 in the direction of arrow "B", block 40 and thus knock-out rod 32 reciprocates in the direction of arrow "C" according to the amplitude of undulating camming groove 46, as is known in the art.

As noted in the background of the description, the use of a knock-out rod 32 has disadvantages, especially where beverage cans are concerned when these beverage cans utilize a pull tab or pop top, such as pop top 21 that has a score that is fractured upon opening the can. These and similar structures will hereinafter be referred to collectively as pull openers. The impact of head 36 onto the mechanical power provided by the reciprocating mounting block 40 can rupture the score seal of the pull opener thus exposing the contents of container 22 to contamination. This contamination can be in the form of intrusive materials, including bacteria or other microbes. Additionally, longitudinal passageway 30 is necessarily filled with a lubricating medium, such as oil or the like. Any leakage through the bearings, seals or bushings associated with spindle 12 and knock-out rod 32 can contaminate the outer surface of lid 20 and, where the pull opener seal is violated, can possibly contaminate the contents of container 22. Further, even if no contaminates are introduced into container 22 should the pull opener seal or rivet integrity be breached, such rupture can nonetheless allow escape of carbonated gases where container 22 is used for a carbonated beverage such as is the practice with the soft drink and beer industries. Accordingly, the present invention contemplates elimination of the entire push rod assembly, including push rod 32, mounting block 40 and cam follower 42. This also can possibly permit faster machine speed by eliminating the inertial mass of the knock-out rod and its associated mechanical linkages. This can be accomplished either in the manufacture of original equipment or as a retrofit structure, explained more thoroughly below.

Figure 2:
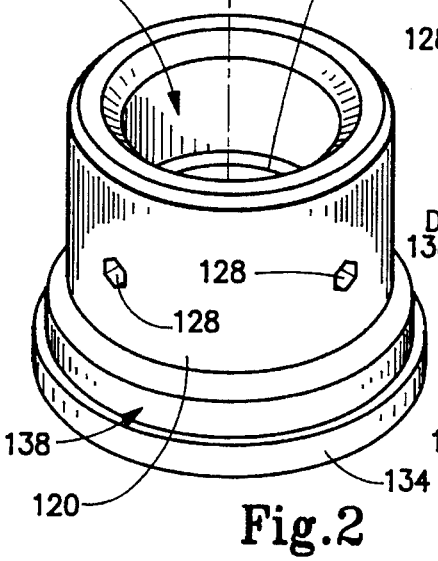
FIG. 2 is a perspective view of a chuck element according to a first exemplary embodiment of the present invention.
Figure 3:
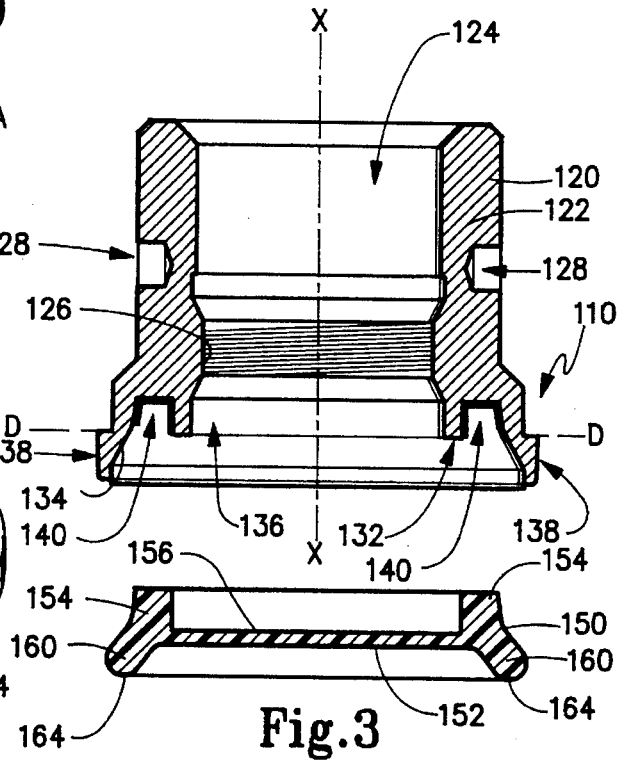
FIG. 3 is an exploded view in cross-section of the chuck assembly shown in FIG. 2 along with the resilient element to be mounted thereon.
Figure 4:
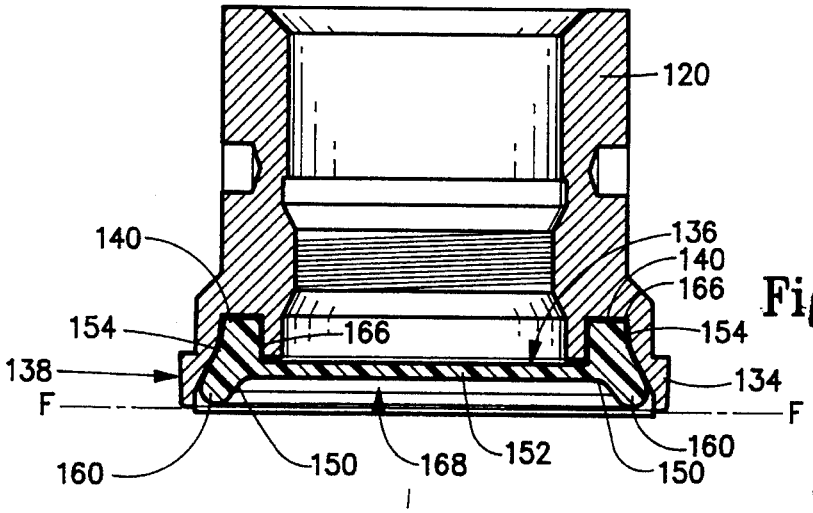
FIG. 4 is a cross-sectional view, similar to FIG. 3, showing the chuck assembly of the first exemplary embodiment including the chuck element and the resilient element mounted thereto.
Figure 5:
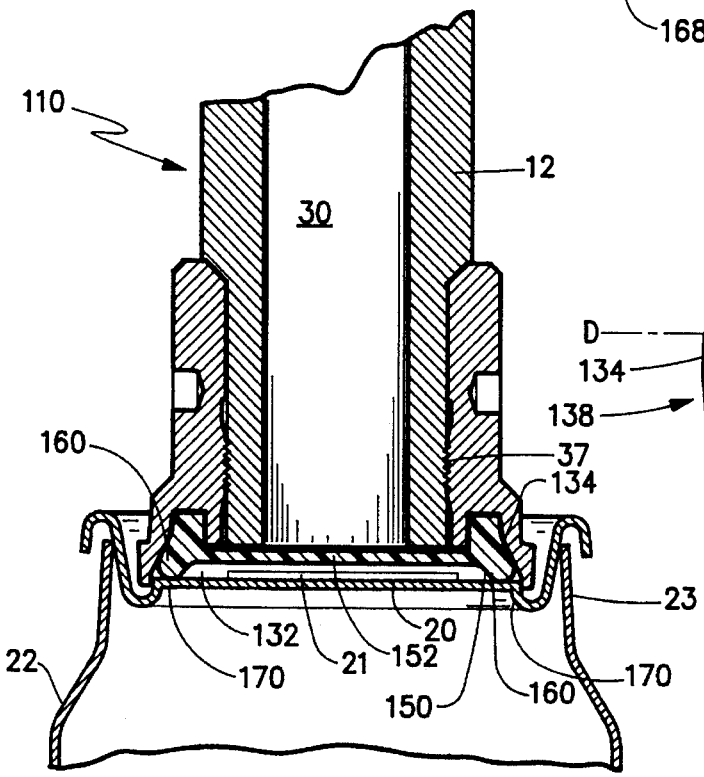
FIG. 5 is a cross-sectional view, similar to FIG. 4, but showing the open end of a beverage can and pop top (pull opener) lid seated on the chuck assembly of FIG. 4 prior to the seaming of the lid and the beverage container together.

With reference to FIGS. 2–7, therefore, a first exemplary embodiment of the present invention is shown in the form of a chuck assembly 110 including a chuck element 120 and a resilient element 150. With reference first to FIGS. 2 and 3, it may be seen that chuck element 120 is in the form of a generally cylindrical tool having a surrounding sidewall 122 so that a longitudinally extending passageway 124 is formed therethrough. It should be understood, however, that differently configured chuck assemblies could be used. For example, lid seaming machines are used for square cans (such as for meat products) including cans provided with pull tab openers (such as some pet food cans, sardine cans, etc.). In any event, an inner wall of sidewall 122 is threaded at 126 so as to be threadably received on the threaded end 37 of spindle 12, as is shown in FIG. 5. Returning again to FIGS. 2 and 3, it may be seen that sidewall 22 includes a plurality of spanner ports 128 so that a wrench may be engaged with chuck element 120 so as to allow loosening and tightening of chuck element 120 onto spindle 12.

Figure 6:
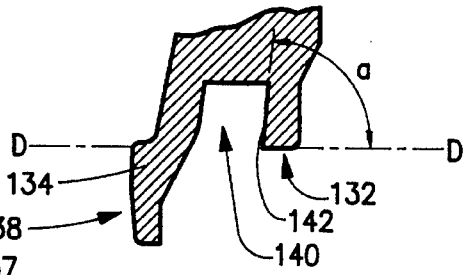
FIG. 6 is an enlarged view, in cross-section showing the chuck element rim and recess that defines a seat for the lid and beverage can shown in FIG. 5.

A distal end 130 of chuck element 120 includes recess 132 surrounded by an upstanding peripheral rim 134. Recess 132 communicates with a central opening 136 to passageway 124 about longitudinal central axis "X". Thus, peripheral rim 134 extends circumferentially around one end of chuck element 120 with rim 134 having an exterior forming surface 138 which cooperates with forming roller 18 to join or "seam" a lid 20 onto an upper rim of can 22. An annular groove 140 is formed )(such as by machining) in recess 132 along the periphery thereof proximate to upstanding rim 134. As is shown in FIG. 6, groove 140 has a wall 142 formed at a large acute angle "a" relative to a transverse plane "D" that is oriented perpendicularly to the central axis "X" of chuck element 120. Preferably, angle "a" is approximately 85°.

Figure 7:
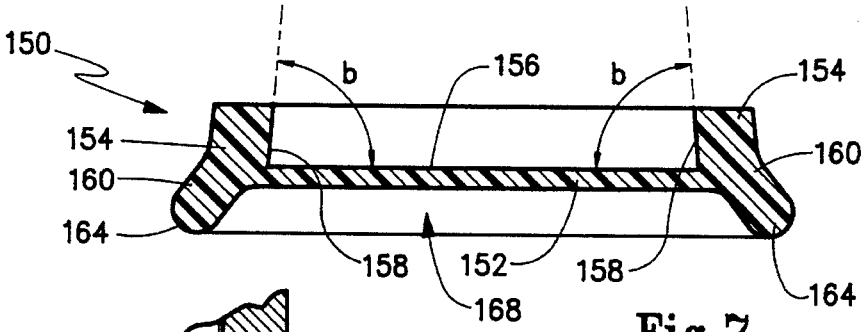
FIG. 7 is an enlarged cross-sectional view of a resilient element for use with the chuck element of FIGS. 2–6.

Resilient member 150 is best shown in FIGS. 3, 4 and 7. As is shown in these figures, resilient member 150 includes a central panel 152 from which an annular ridge structure 154 projects away from a first side 156 thereof. As noted below, ridge structure 154 is sized and adapted to be matably received in annular groove 140 thereby to secure resilient element 150 in a fastened state in the recess 132 of chuck element 120. With reference to FIG. 7, it may be seen that ridge structure 154 has a wall 158 formed at a large acute angle "b" relative to the plane of central panel 152 which corresponds to transverse plane "D" when resilient element 150 is mounted to chuck element 120. Angle "b" is equivalent to angle "a" so that ridge structure 150 may be snap-fitted into engagement with annular groove 140.

With reference again to FIGS. 3, 4 and 7, it may be seen that resilient element 150 also includes a lip structure 160 which projects from a second side 162 of central panel 152 opposite ridge structure 154. Lip structure 162 projects both longitudinally and radially outwardly from central panel 152 and is located proximately to the perimeter of central panel 152. As described below, resilient element 150 acts to eject the lidded container from the forming station when in use.

With reference to FIG. 4, it may now be seen that resilient element 150 is mounted to chuck element 120 by snap-fitting ridge structure 154 into groove 140. To help mount resilient element 150 to chuck element 120, an adhesive may be employed, such as U-shaped adhesive layer 166 shown in FIG. 4. This adhesive may be any suitable mechanical bonding material compatible with resilient element 150 and chuck element 120. To this end, it is preferred that resilient element 150 be constructed of any suitable rubber material including natural or synthetic rubbers, plastics and the like, and it is preferred that resilient element 150 be an integral one-piece construction. Chuck element 120, of course, is normally constructed to tool steel.

In any event, as is shown in FIG. 4, central panel 152 extends transversely across opening 136 in sealed relation thereto. When mounted, lip structure 160 terminates close to plane "F" defined by rim 134.

The functioning of resilient element 150 can now be seen with reference to FIG. 5. In FIG. 5, it may be seen that recess 132 and rim 134 define a seat against which lid 20 and the open upper rim 23 are seated. When lid 20 and container 22 are seated in the engaged position shown in FIG. 5, resilient element 150 and, specifically, lip structure 160 thereof, is engaged by the workpiece in the form of lid 20 such that lip structure 160 of resilient element 150 is collapsed. For purposes of this description, "collapsed" is used to include to conditions both where the material is compressed and to where the structure is resiliently deflected from its normal orientation. Moreover, pull opener 21 is received in cup-shaped recess 168 of resilient element 150 with lip structure 160 contacting a peripheral margin portion 170 of lid 20 spaced from pull opener 21. Central panel 152 acts to seal both opening 136 of chuck element 120, as noted above, and thus longitudinal passageway 30 of spindle 12.

After the forming (e.g., seaming) operation, the positioning mechanism retracts so that the resulting lidded container 22 may be ejected from chuck assembly 110. To assist this, it should now be understood that the resiliency of resilient element 150 and, specifically, lip structure 162 exerts a restorative force on lid 20 thereby acting to eject the lidded container from the forming station. Thus, the rubber material out of which resilient element 150 is molded should be selected as to exert a sufficient force to eject the workpiece according to the application. In lid seaming beverage cans, for example, a total restorative force of twenty pounds when lip structure 160 is collapsed by lid 20. Here, it is preferred that resilient element 150 be formed out of a material having a durometer of approximately sixty to eighty-five on the shore A-scale. Further, the sizing of lip structure should be such that, when contacted by lid 20, it collapses at least 0.040 inch (about 1 mm) so as to exert a suitable restorative force for ejecting the workpiece, i.e., the lidded container. Where resilient element 150 is made out of Kraton G (a trademark of Shell Chemical Company), this collapse provides about twenty pounds of ejecting force.

Alterative exemplary embodiments to the structure described in reference to FIGS. 2–7 are shown, respectively, in FIGS. 8–11. In each of these figures, a representative chuck element 220 is shown threadably received on a representative spindle element 212, although different chuck elements and different spindle elements according to the particular machine and application are of course contemplated. In each of FIGS. 8–11, differing resilient elements and securing fasteners are shown by way of illustrating the principles of the present invention.

Figure 8:
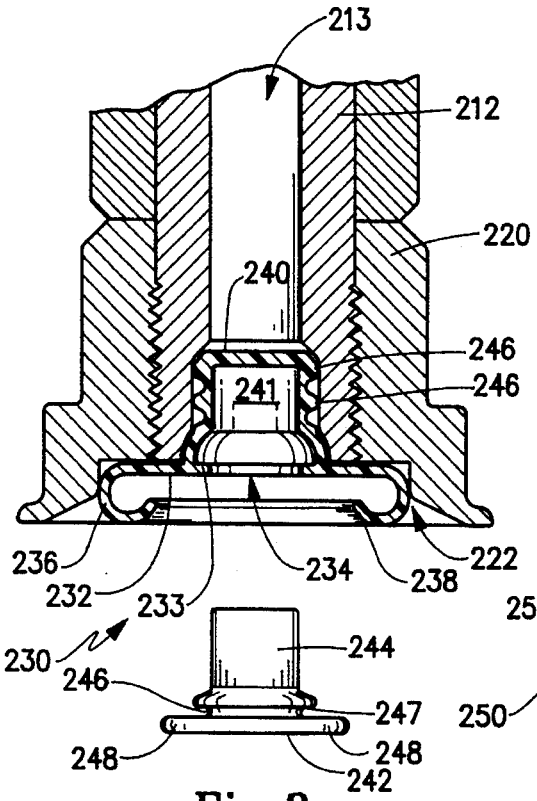
FIG. 8 is a cross-sectional view of a second exemplary embodiment of the present invention.

With reference to FIG. 8, it may be seen that a resilient element 230 is received in recess 222 and includes an annular central portion 232 having a central opening 234 at an inner edge thereof. A lip structure 236 extends outwardly in both a longitudinal and radial direction from annular central panel 232 and terminates in an acute inwardly turned portion 238 which is sized and adapted to contact the workpiece when in the engaged position. A nose portion 240 extends axially of central panel 32 with nose portion 240 being sized and adapted to be inserted into the longitudinal passageway, such as passageway 213 of spindle 212. Nose portion 240 is preferably formed integrally with annular central portion 232 and is operative to seal the central opening of the chuck element as well as seal the longitudinal passageway 213 of the spindle. In order to secure resilient element 230 to spindle 212 and chuck element 220, a fastening plug 242 is sized and adapted to be inserted into the interior 241 of nose 240. To this end, plug 242 has a main body 244 which is matably received in the interior 241 and is thus tapered to collapse ribs 246 formed on the exterior of nose portion 240. Annular central portion 232 has an interior edge 233 which protrudes slightly from the surrounding wall of nose portion 240, and plug 242 includes a radially inwardly extending groove 246 and a radially outwardly extending rib 247 operative to mate with edge 233 when plug 242 is fastened in nose portion 241. Moreover, plug 240 has a radially extending plug flange 248 that overlaps an interior margin of central panel 232 adjacent edge 233 thus helping to securely fasten resilient element 230 onto spindle 212 and chuck element 220.

Figure 9:
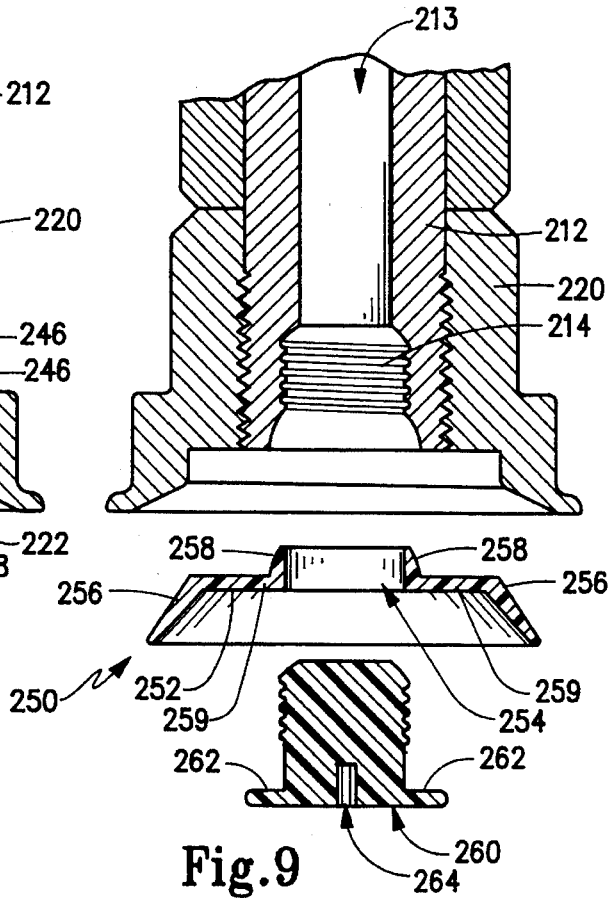
FIG. 9 is an exploded cross-sectional view of a third exemplary embodiment of the present invention.

A third exemplary embodiment of a resilient element according to the present invention is shown in FIG. 9. In this embodiment, resilient element 250 includes an annular central panel 252 surrounding a central opening 254 therein. A lip structure 256 extends outwardly both longitudinally and radially from the perimeter of central panel 252. As is shown in this figure, lip structure 256 is formed by a wall tapered in cross-section so as to exert a variable restorative force as it is collapsed. In order to mount resilient element 250 onto spindle 212 and chuck element 220, spindle 212 is threaded at 214, and a threaded plug 260 is provided for threaded engagement with threaded portion 214 of spindle 212. Resilient element 250 has an aligning shoulder 258 adapted to be inserted into the end of longitudinal passageway 215, and threaded plug 260 may thus be inserted through the opening 254 in resilient element 250 to engage threads 214. Plug 260 includes radially extending plug flange 262 which entraps an inner margin 259 of central panel 252 to seal passageway 213. Plug 260 includes an axial bore 264 selected polygonal cross-section so as to provide engagement for a suitable wrench, such as an allen wrench and the like.

Figure 10:
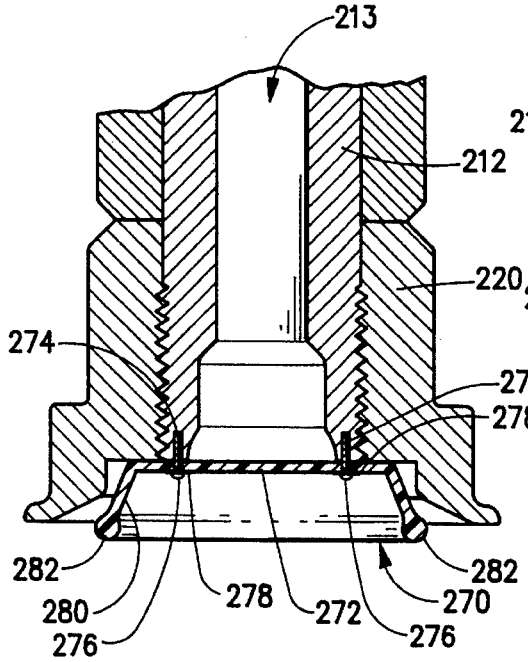
FIG. 10 is a cross-sectional view showing a fourth exemplary embodiment of the present invention.

A fourth exemplary embodiment of the present invention is shown in FIG. 10. Here, resilient element 270 has a central panel 272 which is circular in shape and which extends completely across passageway 213. Central panel 272 is secured by providing threaded bores 274 in the distal end of spindle 212 and threadably mating mounting screws 276 therein. Washers 278 are provided to increase the mounting area for screws 276. Here again, an upstanding lip structure 280 projects longitudinally and radially outwardly from the perimeter of central panel 272. Lip structure 280 terminates in an enlarged lobe 282.

Figure 11:
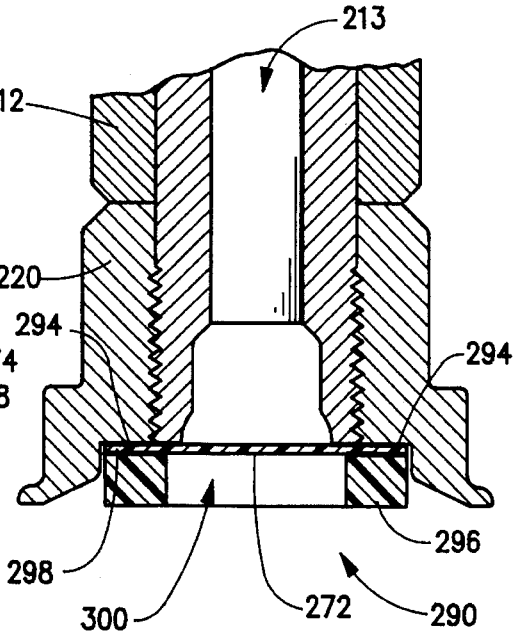
FIG. 11 is a cross-sectional view showing a fifth exemplary embodiment of the present invention.

A fifth exemplary embodiment of the present invention is shown in FIG. 11. Here, resilient element 290 includes a central panel 292 which extends across and is adhered to chuck element 220 by means of an adhesive layer 294 so as to seal passageway 213. An annulus 290 of closed cell foam material is adhered to central panel 292 by means of adhesive layer 298 so that a recess 300 is provided in the interior of annulus 296.

From the foregoing, it should be appreciated that a variety of resilient elements may be constructed according to the teachings of the present invention. Such resilient elements can vary not only in the shape of the structure, such as the lip structure, that is resilient to provide a restored, ejecting force on the workpiece, but also different structures and manners of attaching the resilient element to the spindle and/or chuck element may be employed. Indeed, a chuck element could be constructed in such a manner to be threadably received on the spindle and to itself seal the longitudinal passageway thereof so that it would only be necessary to fasten the resilient element in any convenient manner to such chuck element without concern for sealing the longitudinal passageway against leakage of oil. Thus, it should be appreciated that the skilled artisan in this industry that various changes to the exemplary embodiments may be made based upon the teachings on this specification.

Furthermore, it should be appreciated that the present invention also concerns a method of ejecting a workpiece from a machine that is adapted to perform a machining function. Here, the machine includes a chuck element having a seat adapted to receive the workpiece in an engaged position, at least one forming roller operative to cooperate with the chuck element thereby defining a forming station for performing the machining function, and a positioning mechanism operative to advance so as to move the workpiece into an engaged position in the forming station and to retract whereby the workpiece can be ejected from the forming station. The method according to the present invention broadly includes the steps of first securing a resilient element in a fixed relation relative to the chuck element in a manner such that the resilient element will be contacted by and collapsed by the workpiece when the workpiece is moved into the engaged position. Next, the method includes the step of advancing the positioning mechanism so that the workpiece is moved into the engaged position simultaneously contacting and collapsing the resilient element. Thus, the resilient element exerts a restorative force tending to eject the workpiece from the chuck element. Next, the method includes the step of holding the workpiece in the engaged position against the restorative force until the machining function is completed. Finally, the broad method includes the step of retracting the positioning mechanism after the machining function is completed whereby the resilient element is allowed to rebound to eject the workpiece. Here, the resilient element is constructed such that the restorative force applied by the resilient element is sufficient to reject the workpiece from the forming station after the machining function is performed thereon.

The method according to the present invention can specifically be used with a machine that is a lid seamer wherein the machining function is the seaming of a lid onto an upper rim of the container wherein the lid has a pull opener. Here, the step of contacting the resilient element is performed by the lid and occurs only at portions of the lid located in spaced relation from the pull opener. Further, the method according to the present invention can include any of the steps inherently practiced by the apparatus described above.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. In a machine adapted to perform a machining function on a workpiece wherein said machine has a forming station including at least one forming roller and wherein said machine has a positioning mechanism operative to advance so as to move said workpiece into an engaged position in said forming station wherein the machining function can be performed thereon and to retract whereby said workpiece can be ejected from said forming station, an improvement comprising a chuck element mountable to said machine and having a forming surface cooperative with said forming roller to perform the machining function and including a compressible, polymer-based resilient element mounted to said chuck element and positioned so that when said workpiece is in the engaged position, a portion of said workpiece engages said resilient element such that said resilient element is collapsed whereby, when said positioning mechanism retracts, said resilient element exerts a restorative force on said workpiece thereby to eject said workpiece from the forming station.

2. The improvement according to claim 1 wherein said resilient element is adhered to said chuck assembly by an adhesive.

3. The improvement according to claim 1 including a fastening element operative to engage said chuck element and said resilient element thereby to mechanically mount said resilient element to said chuck assembly.

4. The improvement according to claim 1 wherein said resilient element includes a portion thereof formed of a closed cell foam material.

5. The improvement according to claim 1 wherein said resilient element is formed as an integral piece of molded rubber material.

6. In a machine adapted to perform a machining function on a workpiece wherein said machine has a forming station including at least one forming roller and wherein said machine has a positioning mechanism operative to advance so as to move said workpiece into an engaged position in said forming station wherein the machining function can be performed thereon and to retract whereby said workpiece can be ejected from said forming station, an improvement comprising a chuck element mountable to said machine and having a forming surface cooperative with said forming roller to perform the machining function, said chuck element further having a central axis extending longitudinally therethrough and a recess including a groove formed therein, said recess formed at one end of said chuck element whereby an upstanding peripheral rim extends circumferentially around the one end of said chuck element, and including a resilient element disposed in said recess, said resilient element including a central panel having a ridge structure projecting away from a first side thereof, said ridge structure operative to be matably received in said groove thereby to secure said resilient element in a fastened state to said chuck assembly, said resilient element positioned so that when said workpiece is in the engaged position, a portion of said workpiece engages said resilient element such that said resilient element is collapsed whereby, when said positioning mechanism retracts, said resilient element exerts a restorative force on said workpiece thereby to eject said workpiece from the forming station.

7. The improvement according to claim 6 including an adhesive material in said groove and operative to adhere said ridge structure and said groove together.

8. The improvement according to claim 6 wherein said groove has a wall formed at a large acute angle relative to a transverse plane that is oriented perpendicularly to the central axis of said chuck assembly.

9. The improvement according to claim 8 wherein said ridge structure is formed at the large acute angle whereby said central panel extends transversely of said chuck assembly when in the fastened state with said ridge structure and said groove being in snap-fitted engagement with one another.

10. The improvement according to claim 6 wherein said resilient element includes a lip structure projecting outwardly from a second side of said central panel opposite said first side, said lip structure located proximately to a perimeter of said central panel and sized so that, when said workpiece is seated on said rim, said lip structure is collapsed thereby to exert the restorative force for ejecting said workpiece from the engaged position when said positioning mechanism is retracted.

11. The improvement according to claim 6 wherein said resilient element includes a central panel portion received in the recess and a lip structure projecting outwardly therefrom, said lip structure located proximately to a perimeter of said central panel and sized so that, when said workpiece is seated on said rim, said lip structure is collapsed thereby to exert the restorative force for ejecting said workpiece from the engaged position when said positioning mechanism is retracted.

12. The improvement according to claim 11 wherein said lip structure terminates in an enlarged lobe.

13. The improvement according to claim 11 wherein said lip structure terminates in a arcuate portion turned inwardly from the perimeter of said central panel.

14. The improvement according to claim 11 wherein said lip structure has a lip wall that is tapered in cross-section.

15. A chuck assembly mountable to a machine adapted to perform a machining function on a workpiece wherein said machine includes a spindle adapted to releasably mount said chuck assembly and at least one forming roller operative to interact with said chuck assembly thereby to form a work station operative to perform a machining function on said workpiece, said machine including a positioning mechanism operative to advance so as to move said workpiece into an engaged position in said forming station wherein the machining function can be performed thereon and to retract whereby said workpiece can be ejected from said forming station, said chuck assembly comprising:

(a) a chuck element releasably mountable to said machine and having forming surface cooperative with said forming roller to perform the machining function, said chuck element having a rim and a recess forming a seat sized and adapted to receive a portion of said workpiece when in the engaged position; and (b) a resilient element mounted to said chuck element and disposed in the recess of said seat, said resilient element being sized and adapted so that when said workpiece is in the engaged position, a portion of workpiece engages said resilient element such that said resilient element is collapsed whereby, when said positioning mechanism retracts, said resilient element exerts a restorative force on said workpiece thereby to reject said workpiece from the forming station.

16. A chuck assembly according to claim 15 wherein a groove is formed in said recess, said resilient element including a central panel having a ridge structure projecting away from a first side thereof, said ridge structure operative to be matably received in said groove thereby to secure said resilient element in a fastened state to said chuck assembly.

17. A chuck assembly according to claim 15 wherein said resilient element includes a central panel portion received in the recess and a lip structure projecting outwardly therefrom, said lip structure located proximately to a perimeter of said central panel and sized so that, when said workpiece is seated on said rim, said lip structure is collapsed thereby to exert the restoring force for ejecting said workpiece from the engaged position when said positioning mechanism is retracted.

18. A chuck assembly according to claim 17 wherein said lip structure terminates in an enlarged lobe.

19. A chuck assembly according to claim 17 wherein said lip structure terminates in a arcuate portion turned inwardly from the perimeter of said central panel.

20. A chuck assembly according to claim 15 wherein said lip structure has a lip wall that is tapered in cross-section.

21. A chuck assembly according to claim 15 including a fastening element operative to engage said chuck element and said resilient element thereby to mechanically mount said resilient element to said chuck element.

22. A chuck assembly mountable to a lid seamer that is adapted to seam a lid onto an upper rim of a container to produce a lidded container wherein said lid includes a centrally located pull opener, said lid seamer including an elongated spindle having a longitudinal passageway therethrough that is adapted to slideably mount an ejector rod and that is adapted to releasably mount said chuck assembly and including at least one seaming roller operative to interact with said chuck assembly thereby to define a work station for joining a peripheral edge of said lid and the upper rim of said container, said lid seamer including a positioning mechanism operative to advance so as to move said lid and said container into an engaged position in said forming station and to retract whereby said lidded container can be ejected from said forming station, said chuck assembly comprising:

(a) a chuck element releasably mountable to said spindle and having forming surface cooperative with said forming roller to perform a seaming function, said chuck element having an axial opening that is axially aligned with the longitudinal passageway when said chuck element is disposed on said spindle and including an upstanding rim surrounding a recess together forming an annular seat surrounding the axial opening thereof that is sized and adapted to receive a portion of said lid when in the engaged position; and (b) a resilient element disposed in the recess of said chuck element, said resilient element being sized and adapted so that when said lid is in the engaged position, a peripheral margin portion of said lid engages said resilient element such that said resilient element is collapsed whereby, when said positioning mechanism retracts, said resilient element exerts a restorative force on said lidded container thereby to reject said lidded container from the forming station.

23. A chuck assembly according to claim 22 wherein said resilient member includes a central panel portion received in the recess and an annular lip structure projecting outwardly therefrom, said lip structure located proximately to a perimeter of said central panel and sized so that, when said lid is seated on said rim, said lip structure extends around said pull opener and contacts a peripheral margin portion of said lid and is thereby collapsed so as to exert the restoring force for ejecting the lidded container from the engaged position when said positioning mechanism is retracted.

24. A chuck assembly according to claim 23 wherein said central panel portion extends across the axial opening of said chuck element in sealed relationship thereto so that the longitudinal passageway of said spindle becomes sealed.

25. A chuck assembly according to claim 23 wherein said spindle has a plurality of longitudinal bores formed in a distal end thereof and including fasteners extending through said resilient element and operative to secure said resilient element to said spindle and thus to said chuck element mounted thereto.

26. A chuck assembly according to claim 23 wherein said central panel portion is annular in shape having a central panel opening formed therein, and including a mounting plug having a radially extending plug flange, said mounting plug operative to be inserted through the central panel opening and into the longitudinal passageway so that said plug flange abuts said central panel portion thereby to secure said resilient element to said spindle and chuck element mounted thereon.

27. A chuck assembly according to claim 26 wherein said resilient element includes a nose portion sized and adapted to be inserted into the longitudinal passageway, said nose portion formed integrally with said annular central portion and operative to seal the central opening of said chuck element and the longitudinal passageway of said spindle.

28. A chuck assembly according to claim 23 wherein an annular groove is formed in said recess in surrounding relationship to the central opening, said resilient element including a ridge structure projecting away from said central panel portion on a side thereof opposite said lip structure, said ridge structure operative to be matably received in said groove thereby to secure said resilient element in a fastened state to said chuck element.

29. A chuck assembly according to claim 28 including an adhesive material in said groove and operative to adhere said ridge structure and said groove together.

30. A chuck assembly according to claim 29 wherein said groove has a wall formed at a large acute angle relative to a transverse plane that is oriented perpendicularly to the central axis of said chuck assembly and wherein said ridge structure is formed at the large acute angle whereby said central panel extends transversely of said chuck assembly when in the fastened state with said ridge structure and said groove being in snap-fitted engagement with one another.

31. In a lid seamer that is adapted to seam a lid having a pull tab onto an upper rim of a container to produce a lidded container, said lid seamer including an elongated spindle having a longitudinal passageway therethrough, a chuck element disposed on said spindle and having an upstanding rim and a recess to form an annular seat surrounding an axial opening that registers with said longitudinal passageway when said chuck element is disposed on said spindle and at least one seaming roller operative to interact with said chuck element thereby to define a work station for joining a peripheral edge of said lid and the upper rim of said container, said lid seamer including a positioning mechanism operative to advance so as to move said lid and said container into an engaged position in said forming station and to retract whereby said lidded container can be ejected from said forming station, an improvement comprising a resilient member disposed in the recess of said annular seat of said chuck element, said resilient member being sized and adapted so that when said lid is in the engaged position, a peripheral margin portion of said lid engages said resilient element such that said resilient member is collapsed whereby, when said positioning mechanism retracts, said resilient member exerts a restorative force on said lidded container thereby to reject said lidded container from the forming station.

32. The improvement according to claim 31 wherein said resilient member includes a central panel portion received in the recess and an annular lip structure projecting outwardly therefrom, said lip structure located proximately to a perimeter of said central panel and sized so that, when said lid is seated on said rim, said lip structure extends around said pull opener and contacts said peripheral margin portion of said lid and is thereby collapsed so as to exert the restoring force for ejecting the lidded container from the engaged position when said positioning mechanism is retracted.

33. A chuck assembly according to claim 32 wherein said central panel portion extends across the axial opening of said chuck assembly in sealed relationship thereto so that the longitudinal passageway of said spindle becomes sealed.

34. A chuck assembly according to claim 33 wherein an annular groove is formed in said recess in surrounding relationship to the central opening, said resilient element including a ridge structure projecting away from said central panel portion on a side thereof opposite said lip structure, said ridge structure operative to be matably received in said groove thereby to secure said resilient element in a fastened state to said chuck element.

35. A method of ejecting a workpiece from a machine that is adapted to perform a machining function thereon where said machine includes a chuck element having a seat adapted to receive said workpiece in an engaged position, at least one forming roller operative to interact with said chuck element thereby to define a forming station for performing the machining function and a positioning mechanism operative to advance so as to move said workpiece into an engaged position in said forming station and to retract whereby said workpiece can be ejected from said forming station, comprising the steps of:

(a) securing a compressible, polymer based resilient element in a seat of said chuck element that is defined by a rim and a recess, in a manner such that said resilient element will be contacted by and collapsed by said workpiece when said workpiece is moved into the engaged position;

(b) advancing said positioning mechanism whereby said workpiece is moved into the engaged position simultaneously contacting and collapsing said resilient element thereby to exert a restorative force tending to eject said workpiece from said chuck element;

(c) holding said workpiece in the engaged position against the restorative force until the machining function is completed; and (d) retracting said positioning mechanism after the machining function is completed whereby to allow said resilient element to rebound to eject said workpiece, said resilient element being constructed such that the restorative force applied thereby is sufficient to eject said workpiece from said forming station after the machining function is performed thereon.

36. The method according to claim 35 wherein said machine is a lid seamer and wherein the machining function is seaming a lid onto an upper rim of a container wherein said lid has a pull opener, the step of contacting said resilient element is performed by said lid and occurs only at portions of said lid located in spaced-relation from said pull opener.

* * * * *